United States Patent [19]

Sclafani

[11] 4,237,982

[45] Dec. 9, 1980

[54] ADJUSTABLE DRY SPRINKLER HAVING A LATCHING MECHANISM CONTROLLED BY A SLEEVE

[75] Inventor: Joseph R. Sclafani, Greenwich, Conn.

[73] Assignee: The Reliable Automatic Sprinkler Co., Inc., Mount Vernon, N.Y.

[21] Appl. No.: 902,289

[22] Filed: May 1, 1978

[51] Int. Cl.[3] ..... A62C 37/10

[52] U.S. Cl. ..... 169/37; 151/6; 285/86

[58] Field of Search ..... 169/37, 38, 39, 40, 169/41; 285/86, 92, 35, 302, 319; 151/6, 24

[56] References Cited

U.S. PATENT DOCUMENTS

| | | | |
|---|---|---|---|
| 500,095 | 6/1893 | Bradford | 151/6 |
| 1,346,975 | 7/1920 | Petriw et al. | 151/6 |
| 1,599,189 | 9/1926 | Smith | 151/6 X |
| 1,611,408 | 12/1926 | Bowers | 151/6 |
| 3,194,316 | 7/1965 | Faulkner et al. | 169/37 |
| 3,847,392 | 11/1974 | Horwinski | 239/209 X |
| 4,007,878 | 2/1977 | Anderson | 167/37 X |
| 4,083,410 | 4/1978 | Anderson | 285/302 X |

*Primary Examiner*—Robert J. Spar
*Assistant Examiner*—Fred A. Silverberg
*Attorney, Agent, or Firm*—Brumbaugh, Graves, Donohue and Raymond

[57] ABSTRACT

In the representative embodiment of the invention described herein, an adjustable sprinkler for a fire protection system has a sprinkler assembly tube which is mounted for longitudinal movement in a bore extending longitudinally into a component of a fluid supply piping network for the fire protection system. A latching device is resiliently urged into the bore of the component to prevent accidental removal of the sprinkler assembly tube during its longitudinal movement in the bore by releasably engaging the sprinkler assembly tube before it is completely removed from the bore. When the sprinkler assembly tube is disengaged by the latching device, the sprinkler assembly tube can be removed from the bore.

10 Claims, 1 Drawing Figure

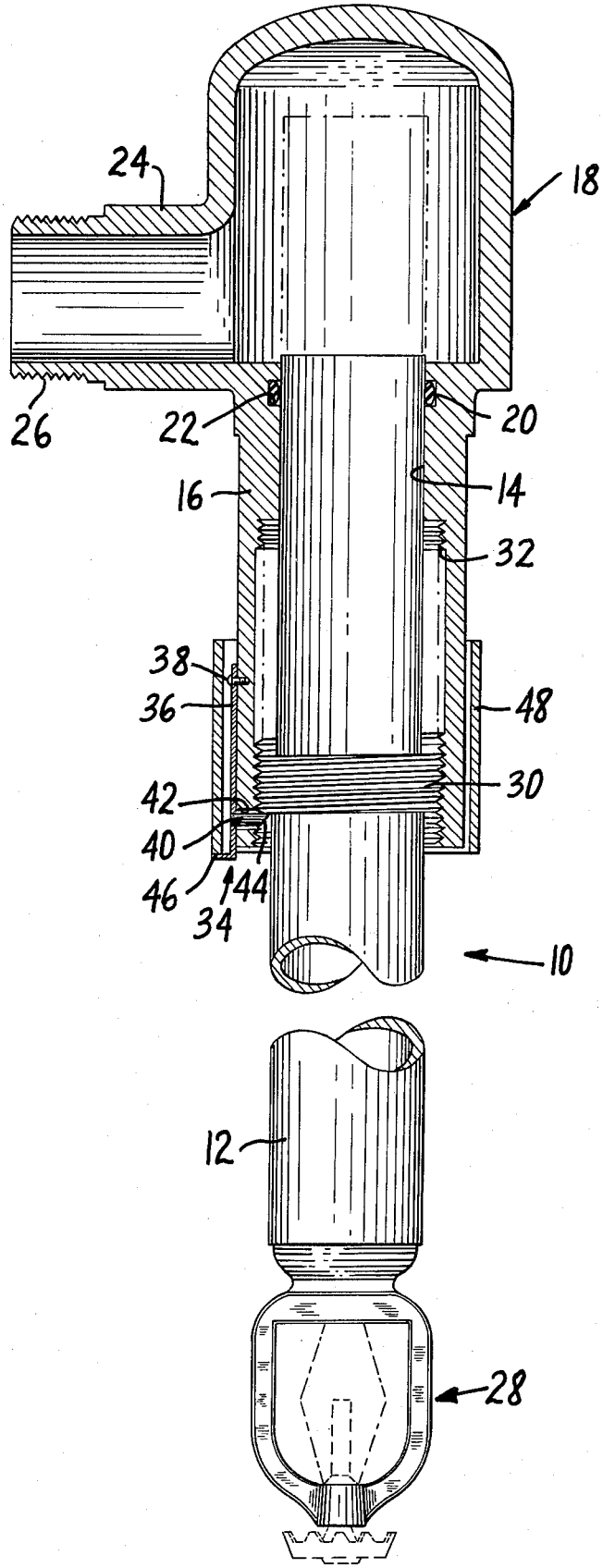
24
18
26
22
20
16
14
32
38
36
48
42
30
40
46
44
34
10
12
28

ADJUSTABLE DRY SPRINKLER HAVING A LATCHING MECHANISM CONTROLLED BY A SLEEVE

FIELD OF THE INVENTION

The present invention relates to an adjustable dry sprinkler for fire protection systems, and, more particularly, to such a sprinkler of the pendent type. The sprinkler of the present invention may be used effectively in dry pipe or wet pipe systems.

BACKGROUND OF THE INVENTION

Fire protection systems commonly utilize a network of supply pipes for conducting a fire extinguishing medium, such as water, to a plurality of automatic sprinklers which may be arranged vertically, either in a pendent position or an upright position, or horizontally. Regardless of how the sprinklers are arranged, they must often be located a specific distance away from the supply pipes, for instance, when pendent sprinklers must be properly located with respect to a hung ceiling or a similar structure.

In the past, drop nipples connecting pendent sprinklers to a supply pipe system have been shortened or replaced with longer nipples to locate the sprinklers at a desired position. To avoid the difficulties and costs involved in shortening nipples which are too long and replacing nipples which are too short, adjustable length nipples have been developed. Such adjustable drop nipples are disclosed, for example, in Faulkner et al. U.S. Pat. No. 3,194,316; Van Houtte et al. U.S. Pat. No. 3,451,483; Adams, Jr. U.S. Pat. No. 3,529,671; Mears U.S. Pat. No. 3,675,952; Iasillo, Sr. U.S. Pat. No. 3,807,503; Horwinski U.S. Pat. No. 3,847,392; Jackson et al. U.S. Pat. No. 4,007,877; and Anderson U.S. Pat. No. 4,007,878.

In the sprinklers disclosed in all of these patents, except the Faulkner et al. and Iasillo, Sr. patents, stops are provided for limiting the downward adjustability of the nipples. However, the stops can not be released or disengaged to permit the disconnection of the nipples from a corresponding fluid supply pipe. Thus, an intermediate fitting must be removably coupled between the fluid supply pipe and the nipple to permit the disconnection of the nipple from the fluid supply pipe. The provision of such a fitting increases construction time and costs, as well as installation time and costs.

The Faulkner et al. and Iasillo, Sr. patents disclose pendent sprinklers having vertically adjustable drop nipples. However, during the vertical adjustment of the nipples, nothing prevents their accidental disconnection from a corresponding fluid supply pipe.

SUMMARY OF THE INVENTION

In accordance with the present invention, there is provided an adjustable sprinkler which includes a sprinkler assembly tube mounted for longitudinal movement in a bore extending longitudinally into some component of a fluid supply system and a latching device which is resiliently urged into the bore of the component. During longitudinal movement of the sprinkler assembly tube in the bore, the latching device prevents accidental removal of the sprinkler assembly tube from the bore of the component by releasably engaging the sprinkler assembly tube when it is moved longitudinally to a predetermined position in the bore.

Inasmuch as the sprinkler assembly tube can be removed from the bore of the component by moving the latching device out of engagement with the sprinkler assembly tube, the sprinkler of the present invention does not have to be provided with an intermediate fitting removably coupled between the sprinkler assembly tube and the component. Moreover, because the latching device is resiliently urged into the bore of the component, even if the latching device were accidentally withdrawn from the bore, it would automatically snap back into the bore.

If the latching device were accidentally withdrawn from the bore and thereby disengaged from the sprinkler assembly tube, its purpose would be defeated. To further avoid this possibility, the sprinkler of the present invention can be provided with a retaining device which cooperates with the latching device to prevent its accidental withdrawal from the bore of the component, as well as its accidental disengagement from the sprinkler assembly tube. The retaining device can be displaced so that it does not cooperate with the latching device to prevent its withdrawal from the bore or its disengagement from the sprinkler asssembly tube.

BRIEF DESCRIPTION OF THE DRAWING

For a more complete understanding of the invention, reference may be had to the following detailed description of an exemplary embodiment taken in conjunction with the accompanying drawing, which is an axial cross-sectional view of the exemplary embodiment.

DESCRIPTION OF AN EXEMPLARY EMBODIMENT

The adjustable dry sprinkler 10 described and illustrated herein includes a sprinkler assembly 12, which may be the outer tube of any conventional sprinkler of the dry type. The sprinkler assembly tube 12 is slideably disposed in an internal bore 14 formed in a vertical leg 16 of an elbow 18. An O-ring 20, housed in an annular groove 22 formed in the radially inner circumferential surface of the vertical leg 16 of the elbow 18, forms a water-tight seal with the sprinkler assembly tube 12. A horizontal leg 24 of the elbow 18 has external threads 26 for connecting the elbow 18 to a fluid supply pipe (not shown) in a fire protection system, the supply pipe conducting water or some other suitable fire extinguishing fluid from a source to any conventional type of sprinkler head assembly 28 mounted on the end of the sprinkler assembly tube 12 projecting downwardly from the vertical leg 16 of the elbow 18.

To provide for the vertical adjustability of the sprinkler assembly tube 12 and therefore the sprinkler head assembly 28, the sprinkler assembly tube 12 has external threads 30 formed along a short generally centrally located length of the sprinkler assembly tube 12 and engaging internal threads 32 formed on the radially inner circumferential surface of the vertical leg 16. The internal threads 32 start at the lowermost end of the vertical leg 16 and extend upwardly a distance great enough to permit longitudinal movement of the sprinkler assembly tube 12 within the vertical leg 16 between a lowermost position (indicated by the solid lines in the drawing) and an uppermost position (indicated by the phantom lines in the drawing).

To prevent accidental removal of the sprinkler assembly tube 12 from the vertical leg 16 of the elbow 18, there is provided a latching device 34 which includes a flat spring 36 fixed at one end by a screw 38 to the radially outer circumferential surface of the vertical leg 16. The flat spring 36 resiliently urges a pin 40, which is permanently attached to the flat spring 36 remote from its fixed end, through a clearance hole 42 extending generally horizontally through the wall of the vertical leg 16 near its lower end and into the bore 14 formed in the vertical leg 16 of the elbow 18. When the sprinkler assembly tube 12 is in its lowermost position, the pin 40 engages the lowermost one of the external threads 30 to restrict further downward movement of the sprinkler assembly tube 12. To prevent withdrawal of the pin 40 from the bore 14 in the vertical leg 16 by forces created when the lowermost one of the external threads 30 engages the pin 40, the lowermost adjacent surfaces of the pin 40 and the hole 42 are arranged close enough to each other so that the adjacent surfaces will be forced into binding contact with each other by any substantial force acting downwardly on the pin 40. The pin 40 has a free end 44 which is formed at an angle to the vertical. The free end 44 of the pin 40 faces downwardly, so that upon insertion of the sprinkler assembly tube 12 into the vertical leg 16 the uppermost one of the external threads 30 contacts the free end 44 resulting in a horizontal component of force which causes the automatic displacement of the pin 40 from the bore 14 of the vertical leg 16 to permit the passage of the external threads 30 and the complete insertion of the sprinkler assembly tube 12.

To further prevent the accidental withdrawal of the pin 40 from the bore 14 of the vertical leg 16, a flange 46 extends outwardly from the free end of the flat spring 36 to form a seat for a cylindrical sleeve 48 which is disposed about the vertical leg 16 and in spaced relation thereto, so that the sleeve 48 can be slid up and down along almost the entire length of the vertical leg 16. The spacing between the sleeve 48 and the vertical leg 16 is such that a portion of the flat spring 36 engages an adjacent surface of the sleeve 48 to stop the movement of the pin 40 before it is completely withdrawn from the bore 14 of the vertical leg 16.

If the sprinkler assembly tube 12 is to be replaced, cleaned or examined, it can be removed from the vertical leg 16 of the elbow 18 by sliding the sleeve 48 upward far enough so that the flat spring 36 will not engage the sleeve 48 prior to the complete withdrawal of the pin 40 from the bore 14 of the vertical leg 16. When the sleeve 48 is displaced upwardly in this manner, the pin 40 can be completely withdrawn from the bore 14 by, for example, gripping the free end of the flat spring 36 and manually pivoting it away from the vertical leg 16. With the pin 40 withdrawn from the bore 14, the sprinkler assembly tube 12 can be removed by rotating it until all of the external threads 30 are no longer engaged by the internal threads 32. Upon release of the flat spring 36, it will automatically snap back to a position substantially parallel with the vertical leg 16 and resiliently urge the pin 40 into the bore 14 of the vertical leg 16. When the sleeve 48 is released, the force of gravity will automatically return it to its rest position on the flange 46 of the flat spring 36.

It will be understood that the embodiment described and illustrated herein is merely exemplary and that persons skilled in the art may make many variations and modifications without departing from the spirit and scope of the invention. For instance, the vertical leg 16 of the elbow 18 can be formed separately from the rest of the elbow 18 and threadedly attached thereto using the same internal threads 32 provided for engaging the external threads 30 on the sprinkler assembly tube 12, whereby the separate vertical leg would function as an adapter fitting for connecting the sprinkler assembly tube 12 to the elbow 18. Moreover, the invention may be adapted for use in wet sprinklers. All such modifications and variations are intended to be included within the scope of the invention as defined in the appended claims.

I claim:

1. An adjustable srpinkler comprising a component having a bore with an open end and adapted to be connected to a fluid supply system, a sprinkler assembly including a tube adapted to be received in the open end of the component bore for longitudinal movement therein, adjustment means on the sprinkler assembly tube for adjusting the longitudinal position of the tube in the bore, and latching means for preventing accidental removal of the sprinkler assembly tube from the component bore while permitting said longitudinal movement, the latching means including an element which is releasably urged in a radial direction into the bore of the component toward the sprinkler assembly tube, the adjustment means providing an abutment projecting from the sprinkler assembly tube toward the component at a location longitudinally spaced from the open end of the component bore providing an unobstructed portion of the sprinkler assembly tube extending away from the abutment toward the open end of the component bore, the latching means element being positioned to intercept the abutment and prevent longitudinal movement of the sprinkler assembly tube from a selected position out of the component bore unless the latching means is released, but to permit longitudinal movement of the sprinkler assembly tube inwardly in the bore from the selected position, and sleeve means surrounding the component adjacent to the latching means and longitudinally movable with respect to the component, the sleeve means normally preventing release of the latching means, but being movable to permit release of the latching means.

2. A sprinkler as defined in claim 1, wherein the adjustment means includes external threads on the sprinkler assembly tube cooperating with internal threads formed in the bore of the component.

3. A sprinkler as defined in claim 2, wherein the external threads are formed along a portion of the sprinkler assembly tube bordered on either side by unthreaded portions.

4. A sprinkler as defined in claim 1, wherein the latching means element projects through a hole extending generally laterally through the component and into the bore therein.

5. A sprinkler as defined in claim 4, wherein the latching means element is attached to a flat spring pivotally attached to the component at a location remote from the element, whereby the element can be pivoted with the flat spring relative to the component when the sleeve means is moved longitudinally to permit release of the latching means.

6. A sprinkler as defined in claim 5, wherein the flat spring has a laterally outwardly extending flange which forms a seat for a retainer sleeve in the sleeve means, the spacing between the retainer sleeve and the component being such that the retainer sleeve is engaged by an adjacent surface of the flat spring when it pivots laterally outwardly away from the component to prevent the disengagement of the latching means element and the abutment, the retainer sleeve being displaceable longitudinally away from the flange of the flat spring a distance great enough to prevent the flat spring from engaging the retainer sleeve, whereby the latching means element can be withdrawn from the bore of the component.

7. A sprinkler as defined in claim 6, wherein the latching means element is a cylindrical pin, the portion of the circumferential surface of the pin most remote from the abutment being arranged close enough to an adjacent surface of the hole so that the adjacent surface of the hole will be engaged by the pin to prevent the withdrawal of the pin from the bore of the component by forces created when the pin is engaged by the abutment.

8. A sprinkler as defined in claim 1, further comprising means cooperating with the sprinkler assembly tube upon insertion of the sprinkler assembly tube into the bore of the component for automatically displacing the latching means element out of the bore of the component to permit complete insertion of the sprinkler assembly tube.

9. A sprinkler as defined in claim 1, wherein the component is a one-piece elbow.

10. A sprinkler as defined in claim 1, wherein the component is an adapter attached to an elbow in the supply pipe system.

* * * * *